US005852975A

United States Patent [19]

Miyabe et al.

[11] Patent Number: 5,852,975

[45] Date of Patent: Dec. 29, 1998

[54] METHOD FOR MAKING LITHOGRAPHIC PLATES USING AN INK-JET PRINTER

[75] Inventors: Masamitsu Miyabe, Oume; Takashi Ohkubo, Koshigaya, both of Japan

[73] Assignee: Kimoto Co., Ltd., Japan

[21] Appl. No.: 701,166

[22] Filed: Aug. 21, 1996

[30] Foreign Application Priority Data

Aug. 29, 1995 [JP] Japan ..... 7-243736

[51] Int. Cl.[6] ..... B41C 1/10

[52] U.S. Cl. ..... 101/463.1; 430/87

[58] Field of Search ..... 101/455, 456, 101/462, 463.1, 465–467; 430/49, 87

[56] References Cited

U.S. PATENT DOCUMENTS

| | | | |
|---|---|---|---|
| 4,659,383 | 4/1987 | Lin et al. | 106/31.29 |
| 4,833,486 | 5/1989 | Zerillo | 101/466 |
| 4,976,997 | 12/1990 | Stockel et al. | 101/465 |
| 5,212,030 | 5/1993 | Figov | 430/49 |
| 5,304,443 | 4/1994 | Figov | 430/49 |
| 5,582,106 | 12/1996 | Kanda et al. | 101/462 |
| 5,607,533 | 3/1997 | Kato | 101/467 |

FOREIGN PATENT DOCUMENTS

| | | |
|---|---|---|
| 56-113456 | 9/1981 | Japan . |
| 56-51109 | 12/1981 | Japan . |
| 59-114543 | 7/1984 | Japan . |
| 5-148439 | 6/1993 | Japan . |
| 5-269958 | 10/1993 | Japan . |
| 7-70490 | 3/1995 | Japan . |

OTHER PUBLICATIONS

Japanese Patent Abstract, 07070490, Mar. 14, 1995.
Japanese Patent Abstract, 5–148439, Jun. 15, 1993.
Japanese Patent Abstract, 56–113456, Sep. 7, 1981.
Japanese Patent Abstract, 5–269958, Oct. 19, 1993.
Abstract, 59–114543, Jul. 2, 1984.
Abstract, 56–51109, Dec. 3, 1981.

*Primary Examiner*—Stephen R. Funk
*Attorney, Agent, or Firm*—Lorusso & Loud

[57] ABSTRACT

The present invention provides a lithographic plate material for a hot-melt type ink-jet printer, characterized in that it comprises an image receiving layer provided on a surface of a flexible plastic film, the image receiving layer being receptive of hot-melt compounds constituting a hot-melt type ink. The image receiving layer, preferably, comprises at least a polymer binder, a pigment becoming hydrophilic upon etching with an etching solution and one or more pigments for imparting unevenness to the surface of the layer. This lithographic plate material is made into a lithographic plate by using the hot-melt type ink-jet printing system. By using this printing system, occurrence of unwanted background image can be completely prevented because there is no possibility of scattering of toner due to electrostatic charging upon peeling.

3 Claims, 1 Drawing Sheet

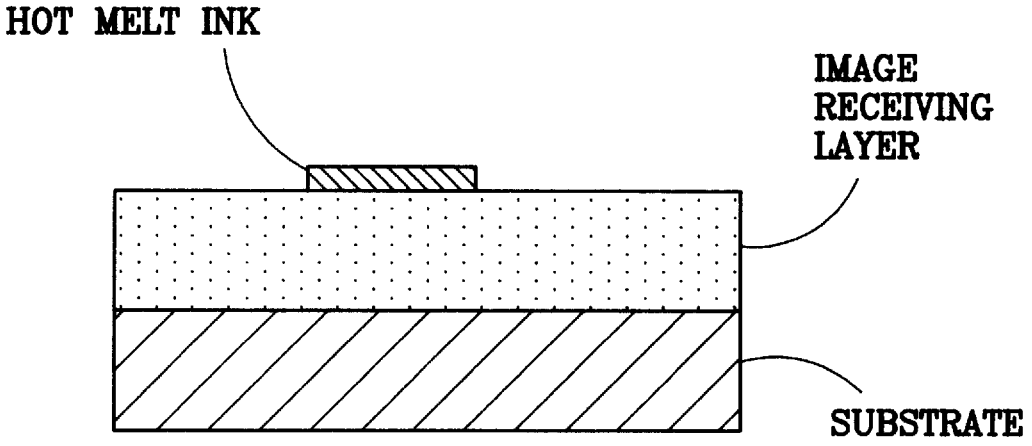
HOT MELT INK
IMAGE RECEIVING LAYER
SUBSTRATE

METHOD FOR MAKING LITHOGRAPHIC PLATES USING AN INK-JET PRINTER

BACKGROUND OF THE INVENTION

1. Field of the Invention

The present invention relates to lithographic plate materials and a method for making lithographic plates using the same.

2. Related Art

With the recent development of office equipment and office automation, lithographic plate materials which can be easily made into lithographic plates by a desk-top publishing (DTP) system using electrophotography, laser beam printing (LBP) or the like have become popular rapidly in the field of short-run offset printing.

In particular, a method for outputting image data from a computer directly to the printing material using an electrostatic transfer printer or other such LBP printer is superior to electrophotography in terms of speed and cost in the making of printing plates since it does not require preparation of a block copy. For this reason, demand for such techniques have been increasing in recent years. For the most part, printing plate materials having an image receiving layer including zinc oxide formed on a water-resistant support have been utilized in the above-mentioned method for making the lithographic plate.

However, scattering of toner onto non-image parts of the material is inevitable in the LBP system since the process of forming a toner image involves temporarily putting toner on a photosensitive drum and then transferring it to the printing material. Namely, the LBP system employs the so-called indirect printing system which comprises 1) reading out image data from a hardware device such as a personal computer and writing it on a photosensitive drum, 2) forming an image on the photosensitive drum by attracting toner to the data portion of the drum and 3) transferring the toner image formed on the drum to the printing plate material to form the image thereon.

When the toner is transferred to the printing plate material, both the drum and the toner image are charged electrostatically upon peeling and, as a result, the toner is scattered in the printer. This scattered toner adheres to portions of the drum where it is not desired and transfers to the lithographic plate material to produce unwanted background.

Generally, the LBP system includes a step for removing excess toner adhering to the drum with a blade once every transferring step, but this step of removing the excess toner is not sufficient for completely removing the scattered toner.

Accordingly, when the method for preparing a printing plate using the indirect printing system such as LBP is employed, even an excellent material with unwanted background preventing property can not completely prevent occurrence of some background. Although the unwanted background is not noticeable at the first stage of offset printing, it becomes increasingly prominent step by step after about two or three hundred-sheets are printed and the printed matter is not suitable for applications which require repeatability or precision.

SUMMARY OF THE INVENTION

An object of the present invention is to provide lithographic plate materials which prevent occurrence of unwanted background image completely and to provide a method for making lithographic plates using the materials.

The invention achieves this object by providing a lithographic plate material for a hot-melt type ink jet printer, characterized in that it comprises an image receiving layer provided on a surface of a flexible plastic film, the image receiving layer being receptive of hot-melt compounds constituting a hot-melt type ink. Preferably, the image receiving layer comprises at least a polymer binder, a pigment becoming hydrophilic upon etching with an etching solution and one or more pigments for imparting unevenness to the surface of the layer. The pigments becoming hydrophilic upon etching with an etching solution may be zinc oxide. The pigment or pigments for imparting unevenness to the surface preferably comprises two kinds of extender pigments having different particle size ranges, the average particle size of one of the pigments ranging from 3 to 5 $\mu$m and the average particle size of the other ranging from 7 to 10 $\mu$m. By imparting a specific surface condition (unevenness) of the image receiving layer, the printing durability and the dampening water retention characteristics of the non-image portion of the layer can be improved.

The method for making a lithographic plate according to the present invention comprises 1) providing a lithographic plate material having an image receiving layer provided on a surface of a flexible plastic film and receptive of hot-melt compounds constituting hot-melt type ink, 2) recording an image on the image receiving layer of the lithographic plate material with the hot-melt ink using an ink-jet printing system and 3) using an etching solution to etch and make hydrophilic parts of the image receiving layer where no hot-melt image is present. Occurrence of unwanted background image on the resulting lithographic plate can be completely prevented by using this hot-melt ink type ink-jet printing system because there is no possibility of scattering of toner due to electrostatic charging upon peeling.

BRIEF DESCRIPTION OF THE DRAWING

The sole drawing FIGURE is a schematic illustration of the lithographic plate material utilized in the method of the present invention with an image of a hot-melt ink formed thereon.

DETAILED EXPLANATION OF THE INVENTION

The lithographic plate materials for hot-melt ink type ink-jet printing of the present invention and the method of making a lithographic plate using the material will be explained in detail hereinafter.

The lithographic plate materials of the present invention comprises a flexible support and an image receiving layer formed on the support which is receptive of hot-melt compounds constituting a hot-melt ink.

The support should be flexible because the lithographic plate material is passed through the ink-jet printer to form the image.

As the flexible support, paper processed to be water resistant or plastic film can be used. Plastic film is particularly preferable in the light of its printing durability and dimensional stability. It may be a film composed of, for example, polyethersulphone, polyester, poly(meth)acrylate, polycarbonate, polyamide, polyvinylchloride or the like. Most preferable is polyester film composed of polyethyleneterephthalate and among such films white polyester film is particularly preferable because it is high in image visibility and excellent in heat resistance and dimensional stability. The thickness may be from 50 to 188 $\mu$m, An anti-curling layer composed of nitrocellulose or the like may be provided on the opposite side of the support to the image receiving layer. When the anti-curling layer is provided, the lithographic plate can be easily attached to a printing cylinder for offset printing.

The image receiving layer formed on the flexible support is constituted so that a hot-melt type ink composed mainly of hot-melt compounds adheres thereto and portions where the hot-melt ink does not adhere can be desensitized by etching process using an etching solution so as to repel the printing ink.

This image receiving layer is composed of at least a polymer binder, a pigment which can be made hydrophilic with an etching solution and one or more pigments for imparting unevenness to the surface of the layer.

The one or more pigments for imparting unevenness to the surface are added to control the surface condition of the image receiving layer and may be an extender pigment having a uniform particle size but are preferably two kinds of extender pigments having different particle size. By employing a combination of two kinds of extender pigment which comprises specific amounts of the extender pigment having a smaller particle size range (referred to as "small particle pigment" hereinafter) and the extender pigment having a larger particle size range (referred to as "large particle pigment" hereinafter), the surface of the image receiving layer can be controlled to have a specific configuration.

By specifically controlling the surface configuration of the image receiving layer, it is possible to improve adhesion of the hot-melt ink, the printing durability and the dampening water retention characteristics.

The small particle pigment has a particle size within the range of 3 to 5 $\mu$m, and the large particle pigment has a particle size within the range of 7 to 10 $\mu$m. The statement that a pigment has a specified particle size range means that the peak size in particle size distribution of the pigment falls within the specified range. The small particle pigment and the large particle pigment are used in a weight ratio of 3:7 to 7:3. In this weight ratio range, no deterioration of adhesion of the hot-melt ink arises.

The small particle pigment preferably has an average particle size of 3 to 5 $\mu$m, because pigments having a particle size of not less than 3 $\mu$m improve dampening water retention characteristics upon offset printing. Pigments having a particle size of not more than 5 $\mu$m improve toner transfer efficiency at the time of printing and prevent decrease in image density.

The large particle pigment preferably has an average particle size of 7 to 10 $\mu$m, because the pigment having a size of not less than 7 $\mu$m can improve adhesion of the hot-melt ink to the image receiving layer and, as a result, improve printing durability. A pigment having a particle size of not more than 10 $\mu$m prevents roughening (objectionable appearances) of the hot-melt ink images and thus prevents spottiness of the printed matter.

As such extender pigments, silica, clay, barium sulfate, alumina and the like may be used alone or in any combination thereof. These extender pigments may be the same as the pigments for making non-image areas hydrophilic described hereinafter. The small particle pigment and the large particle pigment are preferably composed of the same kind of pigment. Silica is particularly preferred, since it can impart desirable hydrophilicity to the image receiving layer.

The pigment which becomes hydrophilic with an etching solution is added to desensitize the image receiving layer. The pigment may be composed of, for example, zinc oxide, titanium oxide, clay, alumina silicate or the like. When a conventional etching solution mainly composed of phosphoric acid is used, zinc oxide is particularly preferred.

The pigment which becomes hydrophilic with an etching solution is preferably used in an amount of 10 to 30 parts by weight, particularly 15 to 25 parts by weight, per 1 part by weight of the pigment(s) for imparting unevenness to the surface. In an amount of not less than 10 parts by weight, the pigment for making non-image areas hydrophilic can impart sufficient hydrophilicity to the image receiving layer and in an amount of not more than 30 parts by weight, can provide excellent film-forming properties.

As the polymer binder, which serves as a binder for these pigments to form the image receiving layer, is used a material which is capable of binding the pigment becoming hydrophilic with an etching solution and the pigment(s) for imparting unevenness to the surface, does not inhibit, but increases the desensitizing ability of the pigment for making non-image areas hydrophilic, and exhibits flexibility in the dried coating.

Examples of polymer binders having such properties are water-soluble resins such as polyvinyl alcohol, carboxymethyl cellulose, hydroxyethyl cellulose, casein, gelatin and water-soluble polyurethane, emulsion resins such as polymers and copolymers of vinyl acetate, vinyl chloride, acrylate esters, styrene, butadiene, ethylene, and the like. These resins may be used alone or any combination thereof. When a water-soluble resin is used alone, it is preferably used with a suitable amount of water-proofing agent to improve printing durability.

The image receiving layer preferably contains the binder in an amount of not more than 15%, preferably, not more than 10%, based on the total weight of the image receiving layer. A binder content of not more than 15% helps to reduce production cost, improve coating properties and increase coating line speed. In addition, it enables sufficient desensitization of non-image areas and therefore reduces contamination during printing.

The lithographic plate material of the present invention can be obtained by preparing a coating solution comprising the aforementioned resin(s) and pigments dissolved or dispersed in an organic solvent such as methylethylketone, toluole or the like and applying the solution to a flexible support using any conventional coating techniques such as bar coating or the like.

The lithographic plate material thus prepared is made into a lithographic plate not by using a conventional indirect transfer printer but by using a hot-melt ink type ink-jet printer. When an ordinary liquid- ink type ink jet printer is used, the liquid ink permeates into the image receiving layer after recording and the image desired to be printed can not be formed on the plate. Further, if the image receiving layer is composed of water resistant resin, the ink does not permeate and drying thereof becomes extremely slow. As a result, the material can not be used for making a lithographic plate.

On the other hand, when the hot-melt ink type ink-jet printer is used, these drawbacks are eliminated and blur does not occur around the ink image, since the hot-melt ink, which is solid at room temperature, is solidified at once after jetting. Further, the resulting lithographic plate has no ink contamination at the non-image areas of its surface, i.e., has no unwanted background image.

Specifically, the lithographic plate material is printed with the hot-melt type ink on its image receiving layer using a hot-melt ink type ink-jet printer which melts and jets ink from a head using, for example, a piezoelectric (PZT)

element and the non-image areas thereof are then subjected to a desensitization process using an etching solution to obtain a lithographic plate. By employing the ink-jet printing system using the hot-melt ink instead of PPC, LBP or other such conventionally employed indirect transfer printing system, occurrence of unwanted image on the non-image areas is completely prevented, since no scattering of the ink occurs in the printer unit.

The hot-melt ink is composed mainly of coloring agents and hot-melt compounds which are solid at normal temperature and are melted by heat energy.

The compounds which are solid at normal temperature and are melted by heat energy have a viscosity enabling them to be jetted at a temperature higher than the melting point. Examples of such compounds include lower alkylamides such as acetamide, propionamide, n-butylamide, lactamide and the like and derivatives thereof, urea derivatives such as dimethyl urea, ethyl urea and the like, methylsulfone, phenylsulfone, carboxylic acids such as benzoic acid, imidazole and such derivatives thereof such as 2-ethyl-imidazole, 1,2,4-triazole and the like, pyrazole and its derivatives such as 3,5-dimethylpyrazol and the like, phenol derivatives such as biphenyl, p-tert-butylphenol, 2,6-tert-butyl-p-cresol and the like, piperazine, alkylbenzene sulfonamides such as o,p-toluene sulfonamide, ethylbenzene sulfonamide or the like, lower alkyl sulfonamide derivatives such as methane sulfonamide and the like, imides such as succinic imide, maleinimide and the like.

Pigments can be used as the coloring agents. For example, organic pigments such as azo, phthalosyanine, anthraquinone, quinacridone, dioxane, indigo, thioindigo, perylene, isoindolenone, aniline black, azomethine azo, lake pigments, carbon black and the like can be used. These pigments are added to the ink in an amount of 0.1 to 10% by weight.

The ink may also contain other components which imparts adhesion properties or other binder resins in order to improve the fixing to the image receiving layer. As the other components, there can be used abietyl esters, tetramides, maleic resins, styrene-butadiene copolymer, vinyltoluene-butadiene copolymer, styrene-acrylate resin, vinyltoluene-acrylate resin, alkyd resin, ethylene-vinylacetate resin, fatty acid amide derivatives such as stearyl-stearamide, ethylene-bis-stearylamide and the like, waxes such as microcrystalline wax, carnauba wax and the like, fatty acid esters of polyhydroxy alcohol such as propylene glycol monohydroxy stearate, glycerol monohydroxy stearate, aliphatick-etones such as stearone and the like, sulfones such as decylsulfone, phenylsulfone and the like, long chain alcohols such as octadecyl alcohol, stearyl alcohol and the like, aliphatic phosphates such as stearyl phosphate and the like, cholesterol and its derivatives such as cholesterol stearylester and the like. Plasticizers such as phthalic esters, polyesters, polyhydroxy alcohols and the like can be added to the ink together with the aforementioned binders.

Further, various kinds of additives such as UV light absorbers, supercooling agents, anti-oxidizing agents, surface-active agents and the like may be added to the ink as occasion demands.

EXAMPLES

The present invention will be explained in detail with reference to working examples.

Example 1

An image receiving layer solution consisting of 45 parts by weight of zinc oxide (SAZEX#2000, Sakai Chemical Industry co., Ltd.), 14 parts by weight of acrylic resin (solid content 50%, ACRYDIC 167, Dainippon Ink & Chemicals, Inc.), 2 parts by weight of synthesized silica (average particle size 3 μm, SYLYSIA 730, Fuji Silysia Chemical Ltd.) and 45 parts by weight of toluole was applied to a polyester film having a thickness of 100 μm (LUMIRROR E-20, Toray Industries, Inc.) by bar coating and dried at 150° C. for 60 seconds to obtain a lithographic plate material for lithography having an image receiving layer with a thickness of 7 μm.

Example 2

A lithographic plate material was prepared in a manner similar to that of Example 1 except that 2 parts by weight of synthesized silica having an average particle size of 12 μm (SYLYSIA 470) was used instead of synthesized silica having an average particle size of 3 μm.

Example 3

A lithographic plate material was prepared in a manner similar to that of Example 1 except that two kinds of synthesized silica having average particle sizes of 4 μm (SYLYSIA 740) and 7 μm (SYLYSIA 770) were used in amounts of 1 part by weight respectively instead of synthesized silica having an average particle size of 3 μm.

Example 4

A lithographic plate material was prepared in a manner similar to that of Example 3 except that the two kinds of synthesized silica having average particle sizes of 4 μm and 7 μm were used in amounts of 0.6 part by weight and 1.4 parts by weight, respectively.

Example 5

A lithographic plate material was prepared in a manner similar to that of Example 3 except that the two kinds of synthesized silica having average particle sizes of 4 μm and 7 μm were used in amounts of 1.4 parts by weight and 0.6 part by weight, respectively.

Example 6

A lithographic plate material was prepared in a manner similar to that of Example 3 except that two kinds of synthesized silica having average particle sizes of 3 μm (SYLYSIA 730) and 10 μm (SILKRON G-602, Nissan Chemical Industries Ltd.) were used respectively instead of two kinds of synthesized silica having average particle sizes of 4 μm and 7 μm.

Example 7

A lithographic plate material was prepared in a manner similar to that of Example 3 except that the two kinds of synthesized silica having average particle sizes of 4 μm and 7 μm were used in amounts of 0.4 part by weight and 1.6 parts by weight, respectively.

Example 8

A lithographic plate material was prepared in a manner similar to that of Example 3 except that the two kinds of synthesized silica having average particle sizes of 4 μm and 7 μm were used in amounts of 1.6 parts by weight and 0.4 part by weight, respectively.

Example 9

A lithographic plate material was prepared in a manner similar to that of Example 3 except that two kinds of synthesized silica having average particle sizes of 2 μm (SYLYSIA 430) and 12 μm (SYLYSIA 470) were used instead of the two kinds of synthesized silica having average particle sizes of 4 μm and 7 μm.

Lithographic plate materials prepared in Examples 1 to 9 were printed using a hot-melt ink type ink-jet printer (JOLT, Hitachi Koki Co., Ltd.) and the non-image areas thereof were subjected to etching process using an etching solution including phosphoric acid as a main component to obtain lithographic plates. Printing was canducted with these lithographic plates using an offset printer (BESTY-AWD1800, TOKO Co., LTD.). "Printing durability" of the lithographic plates, "unwanted background image" of the lithographic plate materials after formation of ink image and prior to etching process and "contamination of printed matters" were evaluated. The results are shown in Table 1.

TABLE 1

| Example | Printing durability | Unwanted background image | Contamination of printed matters |
|---|---|---|---|
| 1 | 10000 | 0 | 0 |
| 2 | 10000 | 0 | 0 |
| 3 | 15000 | 0 | 0 |
| 4 | 15000 | 0 | 0 |
| 5 | 15000 | 0 | 0 |
| 6 | 15000 | 0 | 0 |
| 7 | 7000 | 0 | 0 |
| 8 | 7000 | 0 | 0 |
| 9 | 7000 | 0 | 0 |

"Unwanted background image" was evaluated by using a microscope to count the numbers of image particles measuring not less than 20 μm in diameter per 1mm2 of non-image area.

For evaluaton of "printing durability", printing was continued with a printer (BESTY-AWD1800, TOKO Co., LTD.) until 7-points characters began to wear. The first sign of wear ascertained visually. The number of printings up to the time wear began is shown in the Table 1.

"Contamination of printed matter" was evaluated after 2,000 printings by using a microscope to count the numbers of unwanted image particles measuring not less than 20 μm in diameter per 1 $mm^2$ of non-image area.

Further, with regard to the lithographic plates obtained in Examples 3 and 9, dampening water retension characteristics of the non-image area upon printing and spottiness (objectionable appearance) of the image were evaluated by visual observation.

As can be seen in Table 1, good results were obtained in Examples 1 to 6 with regard to all of printing durability, unwanted background image of the lithographic plate materials after formation of ink image and before etching process and contamination of printed matters. On the other hand, in Examples 7 and 8, good results similarly to Example 1 to 6 were obtained with regard to unwanted background and contamination of printed matters but the printing durability was somewhat low.

With regard to the lithographic plate material of Example 3, the border between the image part and the non-image part of the printed matter, i.e., the edge of the image was exellent in sharpness and the image had no spottiness (objectionable appearance), since the dampening water retension characteristics of the non-image area of the lithographic plate material of Example 3 were good. On the contrary, with regard to the plate material of Example 9, though the edge of the image was sharp, spottiness (objectionable appearance) of the image due to roughness of the surface of the plate material was observed.

As is clear form these examples, lithographic plates were prepared with no occurrence of unwanted background by using the hot-melt ink type ink-jet printer and printed matters having no contamination on the non-image area were obtained by printing with these lithographic plates.

Further, the printing durability of lithographic plates was improved when the specified lithographic plates material was used.

We claim:

1. A method for making a lithographic plate comprising:

1) providing a lithographic plate material comprising a flexible support and an image receiving layer formed on the support and receptive of hot-melt compounds which are components of a hot-melt ink, said image receiving layer comprising a polymeric binder, a pigment which becomes hydrophilic upon contact with an etching solution and two extender pigments wherein one of said extender pigments has a particle size of from 3 to 5 μm and the other of said extender pigments has a particle size of from 7 to 10 μm;

2) recording an image on the image receiving layer with the hot-melt ink using a hot-melt ink type ink-jet printing system; and 3) etching away hydrophilic portions of the image receiving layer where no image is present by contacting the image receiving layer with the etching solution.

2. The method for making a lithographic plate of the claim 1, wherein the pigment which can be made hydrophilic with the etching solution is zinc oxide.

3. The method for making a lithographic plate of the claim 1, wherein the weight ratio of the two kinds of extender pigments is from 3:7 to 7:3.

* * * * *